US006590148B1

(12) United States Patent
Medina

(10) Patent No.: US 6,590,148 B1
(45) Date of Patent: Jul. 8, 2003

(54) BOOK HOLDER WITH INTEGRAL PAGE HOLDER/PAGE TURNER APPARATUS

(76) Inventor: Albert Medina, 2649 S. Cochran Ave., Los Angeles, CA (US) 90016

( * ) Notice: Subject to any disclaimer, the term of this patent is extended or adjusted under 35 U.S.C. 154(b) by 10 days.

(21) Appl. No.: 10/052,689

(22) Filed: Jan. 18, 2002

(51) Int. Cl.[7] ..... G10G 7/00
(52) U.S. Cl. ..... 84/486
(58) Field of Search ..... 84/486–494, 502–507, 84/509, 514, 516, 517

(56) References Cited

U.S. PATENT DOCUMENTS

| | | | | | |
|---|---|---|---|---|---|
| 415,051 | A | * | 11/1889 | Miller | 84/494 |
| 692,320 | A | * | 2/1902 | Lombardero | 84/486 |
| 896,480 | A | | 8/1908 | Swanson | |
| 940,219 | A | | 11/1909 | Van Dine | 84/487 |
| 1,059,901 | A | | 4/1913 | Neiman | 84/487 |
| 1,164,355 | A | | 12/1915 | Johnson et al. | 84/504 |
| 1,215,262 | A | | 2/1917 | Faist | 84/486 |
| 1,339,261 | A | | 5/1920 | Jolley | 84/487 |
| 1,397,885 | A | | 11/1921 | Stevens | 84/487 |
| 1,735,166 | A | | 11/1929 | Hossell et al. | 84/486 |
| 2,755,580 | A | | 7/1956 | Justice | 40/531 |
| 2,791,847 | A | | 5/1957 | Hagman | 40/531 |
| 2,885,806 | A | | 5/1959 | Storm, Jr. et al. | 484/531 |
| 2,991,680 | A | | 7/1961 | Elliott | 84/517 |
| 4,463,651 | A | | 8/1984 | Hammer | 84/504 |
| 4,553,467 | A | | 11/1985 | Goldner | 84/487 |
| 4,685,374 | A | | 8/1987 | Goldner | 84/487 |
| 4,882,969 | A | * | 11/1989 | Ricca | 84/487 |
| 4,936,034 | A | | 6/1990 | Chen et al. | 40/531 |
| 5,233,900 | A | | 8/1993 | Fitzgerald | 84/497 |

* cited by examiner

*Primary Examiner*—Shih-Yung Hsieh
(74) *Attorney, Agent, or Firm*—Bissell & Bissell; Henry M. Bissell; Henry M. Bissell, IV

(57) ABSTRACT

Apparatus for holding a book or the like with its pages in an open position to permit viewing the displayed pages. The page holding assemblies on right and left sides of the book have rotatable members which facilitate the turning of a page from one side to the other without disrupting the function of holding the other pages of the open book in place.

14 Claims, 7 Drawing Sheets

BOOK HOLDER WITH INTEGRAL PAGE HOLDER/PAGE TURNER APPARATUS

BACKGROUND OF THE INVENTION

1. Field of the Invention

The present invention generally relates to book holding apparatus and, more particularly, to such apparatus which incorporates assemblies for manually turning the pages of a book, when desired, and retaining the pages in position both before and after they are turned.

2. Description of the Related Art

The prior art is replete with examples of devices which serve to hold a book in a particular position so that a reader can read the exposed pages without having to hold the book himself. More elaborate apparatus may not only hold the book open but also turn the pages when desired or signaled by the reader.

The need for such apparatus has arisen for the handicapped as well as for those who need to read material contained in book form while using their hands for other things, such as pianists or other musicians who have resort to such apparatus while playing their instruments and reading music. It is also a matter of convenience for many people who do not consider it a necessity.

A number of such devices are disclosed in U.S. Pat. Nos. 896,480, 940,219, 1,059,901, 1,164,355, 1,215,262, 1,339,261, 1,397,885, 1,735,166, 2,755,580, 2,791,847, 2,885,806, 2,991,680, 4,463,651, 4,553,467, 4,685,374, 4,936,034, and 5,233,900. A brief reference to any of these patents will illustrate the general elaborateness and complexity of the disclosed apparatus, most of which are equipped with motors or other powered devices for activating the mechanisms which are provided for turning the pages.

Many of these devices were unreliable, inconvenient to use or simply not functional. Many of them are costly as well, cumbersome and difficult or inconvenient to attempt to use. Accordingly, they are generally not commonly marketed items.

Typical of these devices are the arrangements disclosed in the two Goldner U.S. Pat. Nos. 4,553,467 and 4,685,374, the latter being a continuation-in-part of the former. Both disclose a motor driven, rotating assembly having a plurality of spokes or arms extending from a central hub. In both, the rotating assembly comprises a first pair of opposed elongated arm members as page turners and a second pair of elongated arms, shorter in length than the arms of the first pair, to serve as hold-down members. While the present invention shares the objectives of page turning and page holding which are asserted for the Goldner devices, the structure disclosed herein is vastly different from the structures of Goldner.

SUMMARY OF THE INVENTION

In brief, particular arrangements in accordance with the present invention comprise a pair of like assemblies mounted on an easel which supports the book in which the pages are to be turned. The easel in turn is supported on an adjustable stand. A pair of straps serve to hold the book in a central position on the easel.

In this arrangement, the assembly on the right-hand side of the easel includes a pair of rods generally mounted orthogonally to each other. These rods are mounted on a pivot axis which is reciprocally rotatable. As the rods reciprocate about the pivot axis, they respectively alternate between holding the exposed page on the right-hand part of the book flat against the stand and releasing the exposed page so it can be turned manually to the other side of the book where the turned pages are collected. As the reciprocal rotation continues, the page-turning rod moves into position to hold the next page flat against the book while the other rod moves from the page-holding position to a position where it will turn the next page when the assembly is pivoted back toward the first position.

The rod assembly on the left-hand side of the easel is identical to the rod assembly on the right-hand side, merely being mounted in an inverted position relative to the right-hand side rod assembly. This results in its presenting a mirror image of the right-hand side rod assembly. Reciprocating rotation about the pivot axis of the rod assembly on the left-hand side results in a page which has been turned being added to the stack of pages already collected, while this stack is retained in position against the easel.

The mounting brackets for these assemblies are adjustable with respect to the easel along slots in the easel so that each assembly may be adjusted upward or downward in position. The mounting brackets also permit adjustment of the rod assemblies in directions which are orthogonal to the easel, thereby enabling them to compensate for variations in thickness of the portions of the book which are respectively held by these assemblies.

The easel itself, in a preferred embodiment of the invention, is mounted on a cylindrical horizontal member in a manner which permits the easel to be adjusted both as to the angle at which the book is supported, varying between vertical and horizontal, as well as being adjustable transversely between left and right.

The cylindrical support member is itself mounted on a vertical support member which may be adjusted to vary the height at which the easel is maintained. The base of the stand is provided with extended stabilizing feet which serve to maintain the stand stable and keep it from tipping over.

BRIEF DESCRIPTION OF THE DRAWINGS

A better understanding of the present invention may be realized from a consideration of the following detailed description, taken in conjunction with the accompanying drawings, in which.

DESCRIPTION OF THE PREFERRED EMBODIMENTS

Figures 1, 2, 3:
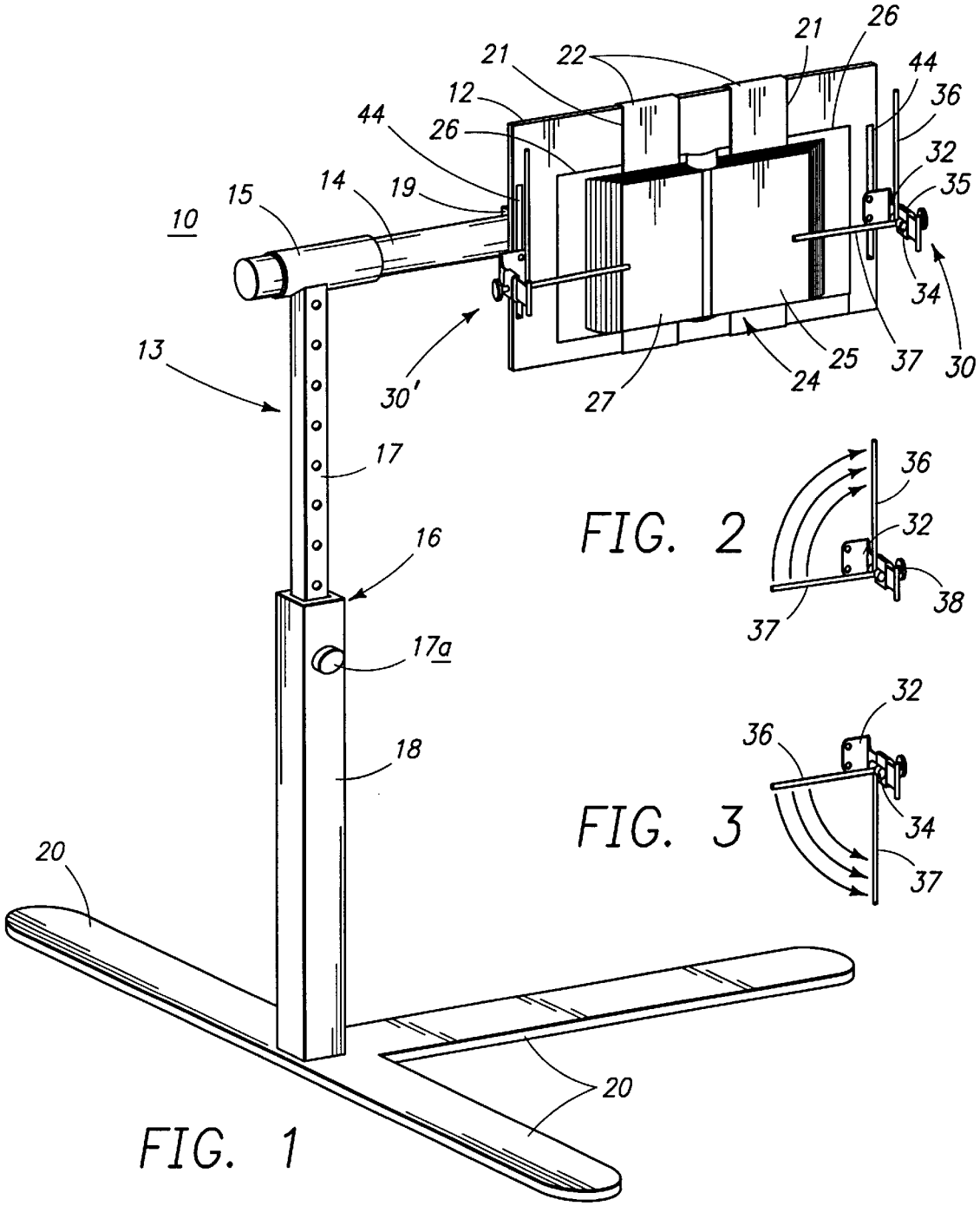
FIG. 1 is a schematic perspective view of one particular arrangement in accordance with the present invention.
FIG. 2 is a schematic view of the page turning/page holding device on the right-hand side in the arrangement of FIG. 1, shown in a first position.
FIG. 3 is a schematic view of the device of FIG. 2 in a second position.

As shown in the drawings, book holder/page turner apparatus 10 comprises an easel 12 on a supporting stand 13. The stand 13 includes a cylindrical bar 14 mounted on a vertical support member 16 by means of a mount 15. The mount 15 is a hollow cylindrical member which allows for adjustment of the bar both axially and rotationally. Thus the angle of the easel 12 can be adjusted by rotating the bar 14 within the mounting member 15. The easel 12 is affixed to the bar 14 by a mounting member 19, just visible behind the easel on the left-hand side.

The vertical support member 16 comprises a telescoping arrangement in which an upper support portion 17 slides vertically within a lower support portion 18 and is held at a selected position by a pin 17*a*. The support 18 is affixed to feet 20 oriented in a tee configuration for stability.

The easel 12 is shown supporting a book 24 which is held in place by a pair of straps 21, extending about the easel 12 and retained by suitable retention members 22, which may be made of Velcro® or the like. These straps 21 engage the covers 26 of the book 24. The right-side pages are designated 25; the left-side pages are designated 27.

The easel 12 is equipped with a pair of assemblies 30, 30' which hold the book open and facilitate the turning of the pages. The right-side assembly 30 comprises a pair of rods 36, 37 which are fixed at right angles to each other in a pivot member 34. As will be explained hereinafter, the rods 36, 37 perform both the page turning and page holding functions when controlled manually by the user. The left-side assembly 30' is the same as the right-side assembly 30, mounted as a mirror image or, alternatively, it may be considered to be in an inverted position relative to the right-side assembly 30. In the drawings, the same elements of the left-side assembly have been given the same reference numerals of the elements of the right-side assembly, with the addition of the prime symbol to clarify the description. Both assemblies 30 and 30' are mounted on the easel 12 by means which extend through slots 44 to fasteners on the back side (not shown) so that these assemblies may be adjusted upwardly or downwardly with respect to the easel 12 in order to accommodate books of different sizes.

Figure 4:
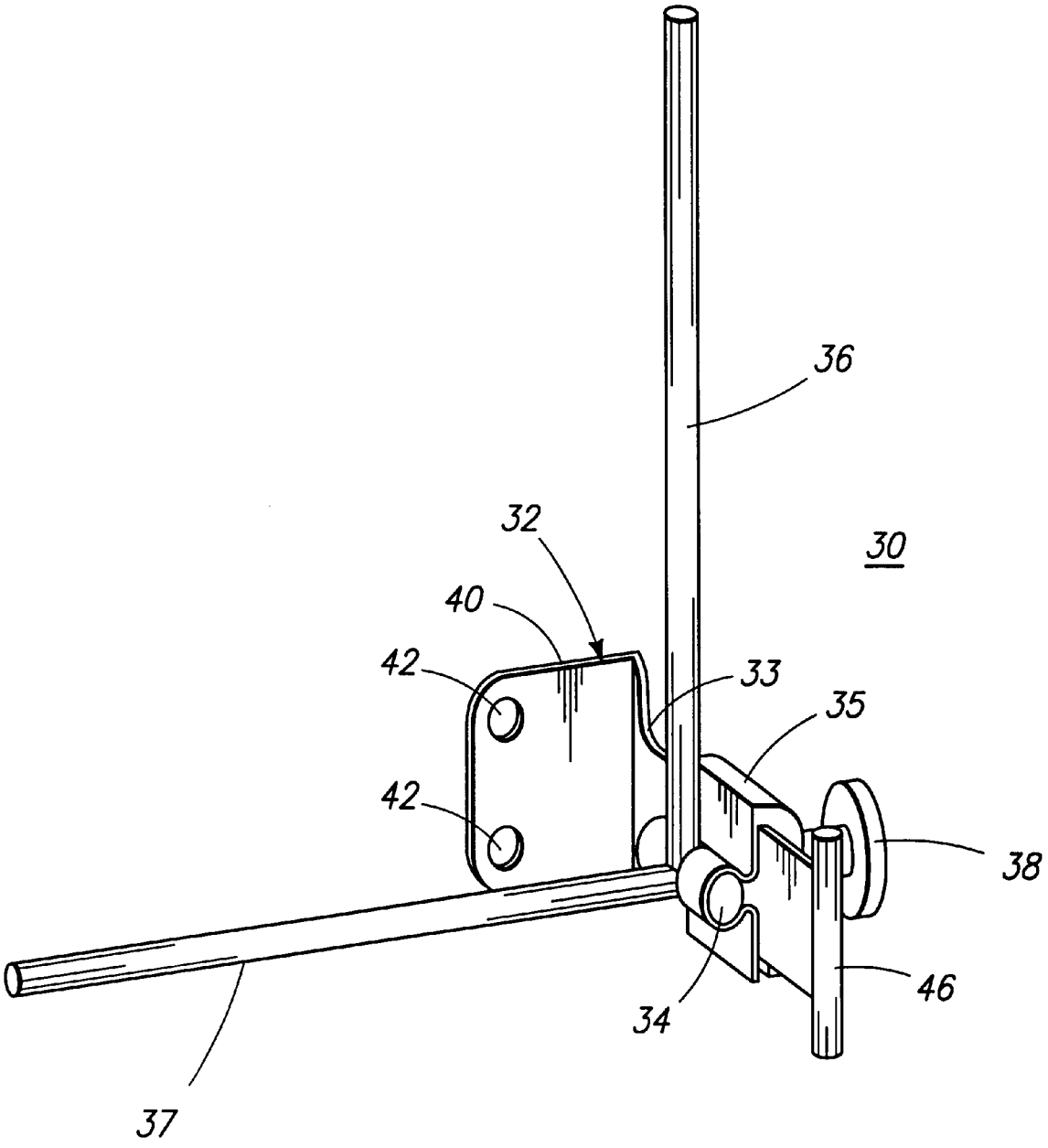
FIG. 4 is an enlarged view of the device of FIGS. 2 and 3 showing further details of the construction.
Figure 5:
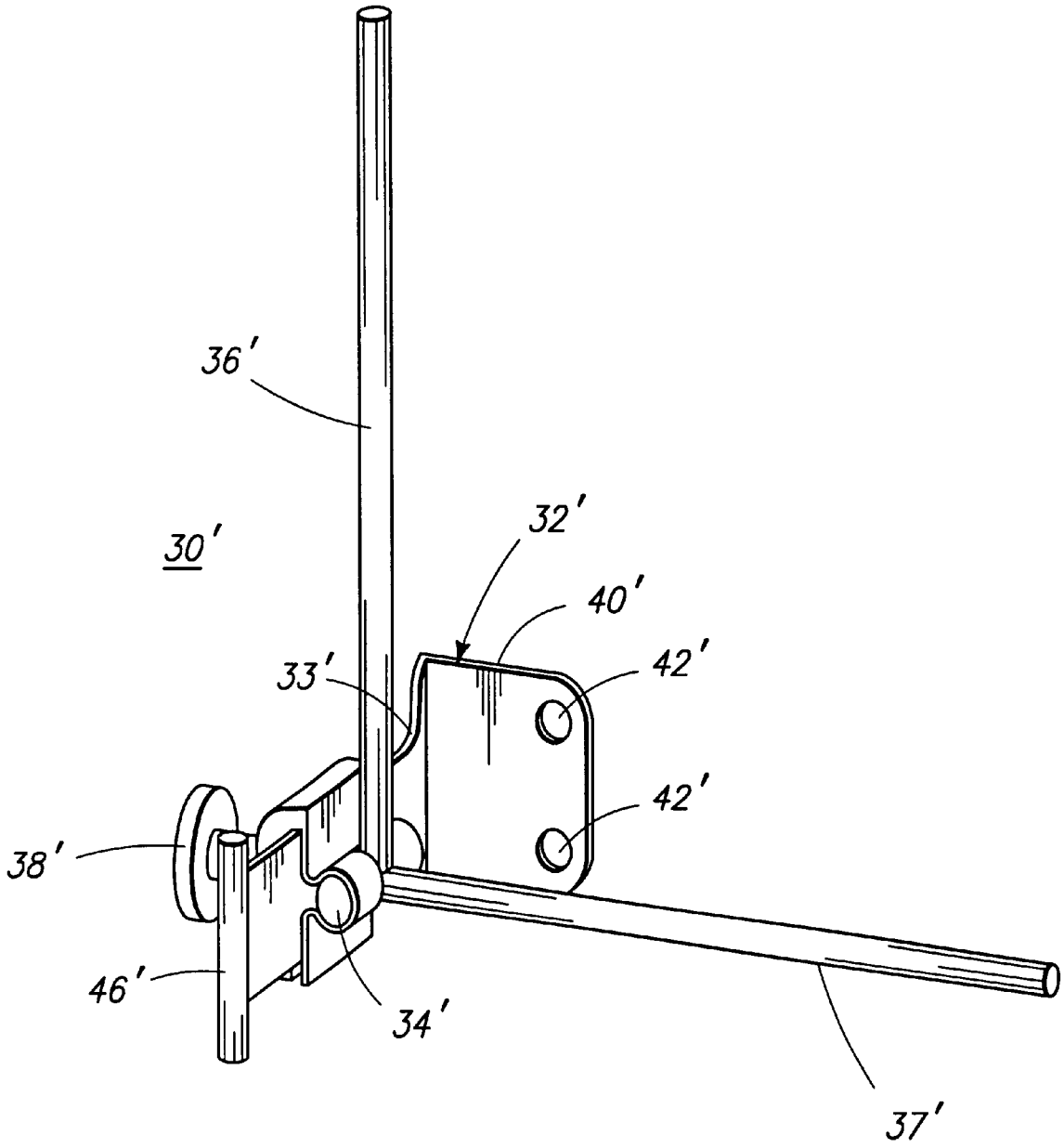
FIG. 5 is a schematic view of the page turning/page holding device on the left-hand side of the arrangement of FIG. 1, shown in a first position.

As best shown in FIG. 4, the right-side assembly 30 includes a bracket 32 with a base 40 and screws which extend through mounting holes 42 for mounting the bracket at the slot 44. The bracket 32 has an outwardly extending limb 33 for adjustable mounting of the rods 36, 37. The pivot member 34 is affixed to a clamp 35 which is slidable along the limb 33 toward or away from the easel 12. A thumbscrew 38 permits locking the clamp 35 at the desired position along the bracket 32. At the outer end of the limb 33 is a handle 46 to facilitate adjusting the bracket to the desired position. The element 46 also serves as a stop member, preventing the clamp 35 from sliding off the bracket 32.

The above-description applies to the left-side assembly 30' as well, simply priming each of the reference numerals to make the description fit.

Figure 6A:
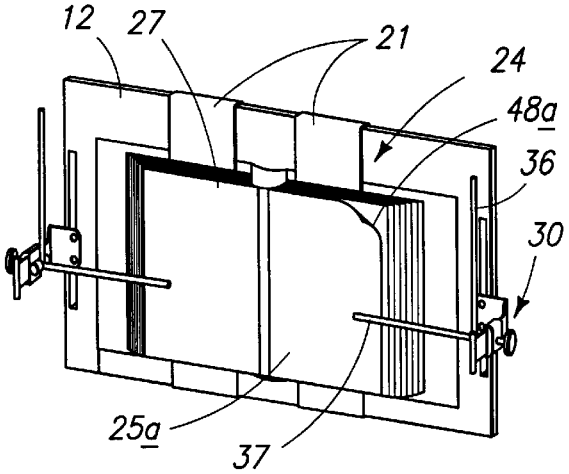
FIGS. 6A–6D are a series of schematic views of the arrangement of FIG. 1 showing the motion of the device of FIGS. 2 and 3 in turning a page of a book while retaining the pages underneath it.

FIGS. 6A–6D illustrate the way in which the assembly 30 may be manipulated to turn page 25*a* while retaining the remaining pages 25 on the right-hand side of the book 24 in position. In FIG. 6A, the first rod 36 is shown holding the pages 25 on the right-hand side while the upper corner 48*a* of the page 25*a* is lifted in preparation for pivoting of the first and second rods 36, 37.

Figure 6B:
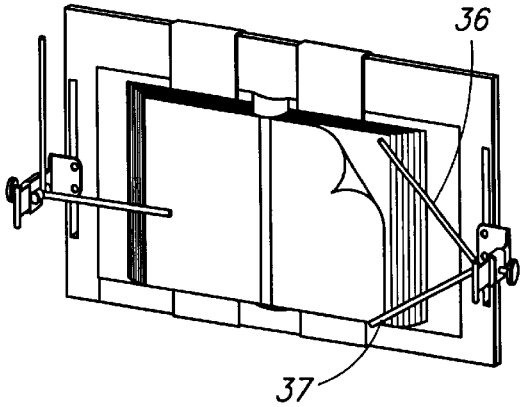
Figure 6C:
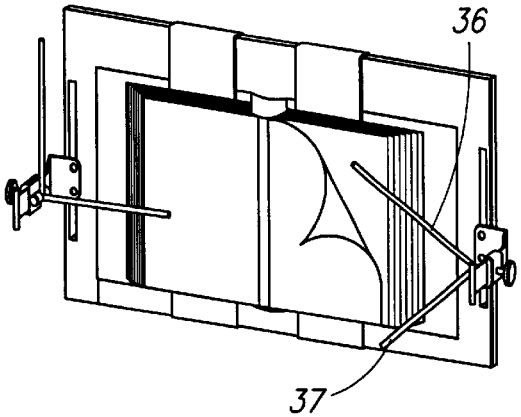
Figure 6D:
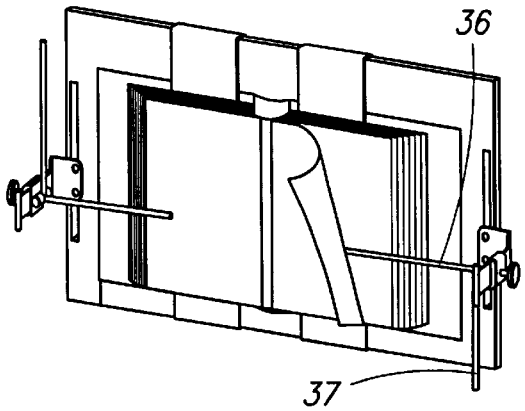

As seen in FIGS. 6B and 6C, as the rods 36, 37 are rotated in the counterclockwise direction about the pivot member 34, the first rod 36 drops in behind the page 25*a* and takes over the page retaining function as that function is vacated by the second rod 37. In FIG. 6D, the first rod 36 is shown holding the pages of the right-hand portion of the book in place on the easel 12 while the page 25*a* is freed to be moved to the left-hand side and engaged by the rod 37' of the left-hand assembly 30'.

Figure 7A:
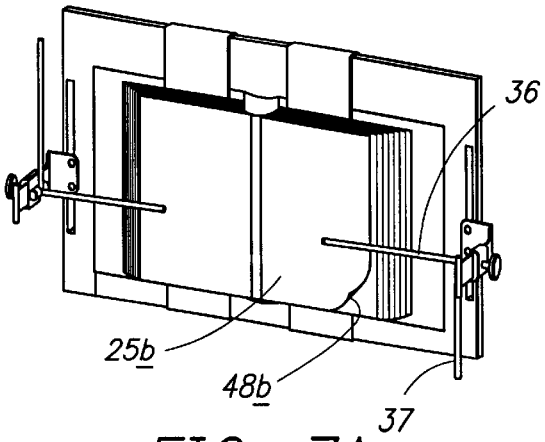
FIGS. 7A–7D are schematic views showing the motion of the device of FIGS. 2 and 3 in the reverse direction to turn the next page of the book while retaining the following pages.
Figure 7B:
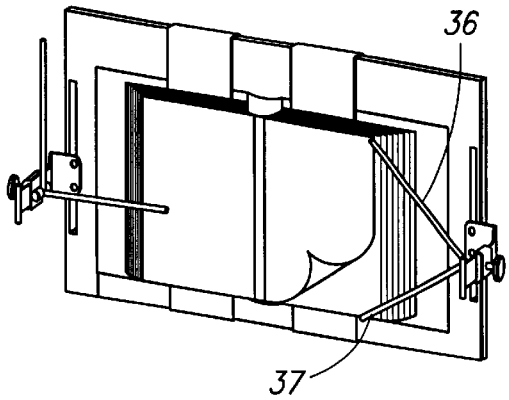
Figure 7C:
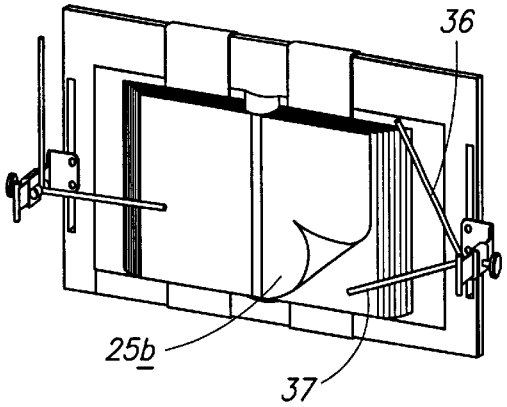
Figure 7D:
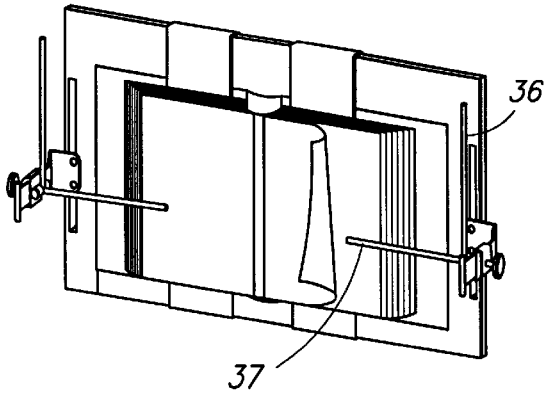

The right-hand assembly 30 is now ready to begin the next sequence which is shown in FIGS. 7A–7D. For the next page 25*b*, the lower corner 48*b* is lifted while the pivot member is moved in a clockwise direction. The first rod 36 clears the page 25*b* as the second rod 37 moves into position to retain the succeeding pages underneath page 25*b*. In FIG. 7D the page 25*b* is now clear of the first and second rods 36, 37 so that it may be turned to the left side to be slid under the rod 36' of the left-hand assembly 30'.

Figure 8A:
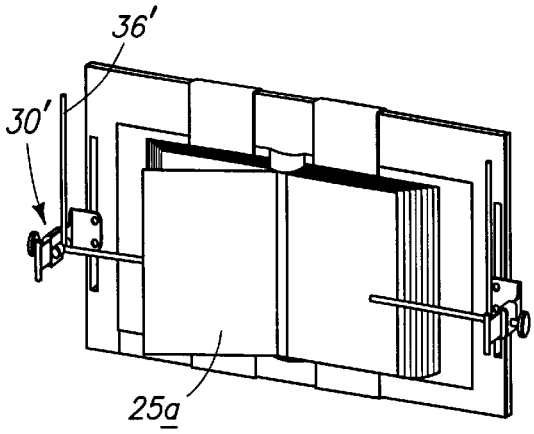
FIGS. 8A–8D are a series of schematic views of the arrangement of FIG. 1 showing the positions of the device on the left-hand side of the easel in receiving a turned page from the right-hand side and adding it to the stack of retained pages on the left-hand side.
Figure 8B:
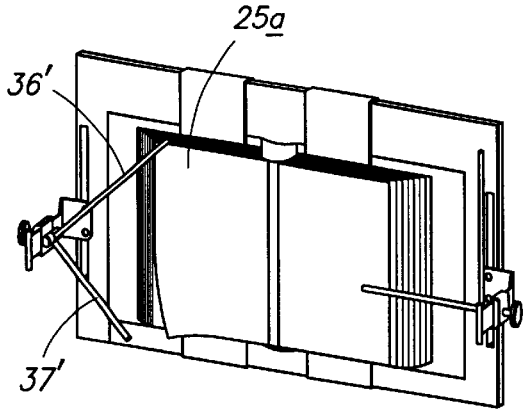
Figure 8C:
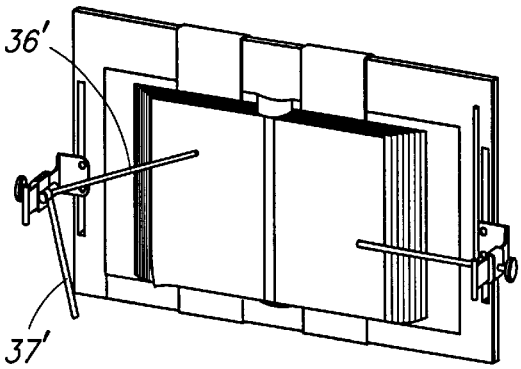
Figure 8D:
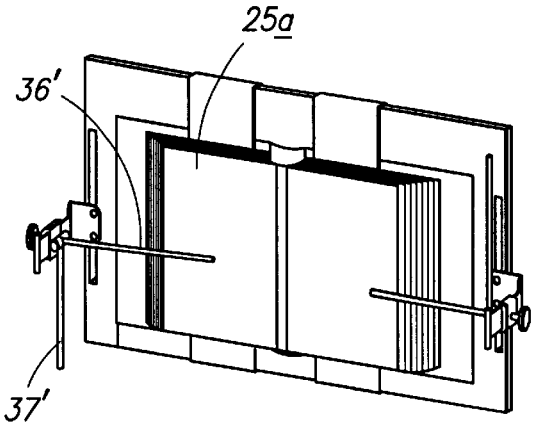

The action of the left-hand assembly 30' is shown in the schematic views of FIGS. 8A–8D and 9A–9D. FIG. 8A shows the assembly 30' in position ready to receive a page 25*a* as it has been turned to the left-hand side after release by the assembly 30 on the right-hand side. Clockwise rotation of the assembly 30' begins with the upper left-hand corner of the page 25*a* being tucked underneath the rod 36' (see FIG. 8B). Clockwise rotation of the assembly 30' continues through FIG. 8B and 8C until the page 25*a* is in place on the stack of pages on the left-hand side of the book, retained by the rod 36', with the rod 37' being moved to a position ready to receive the next turned page.

Figure 9A:
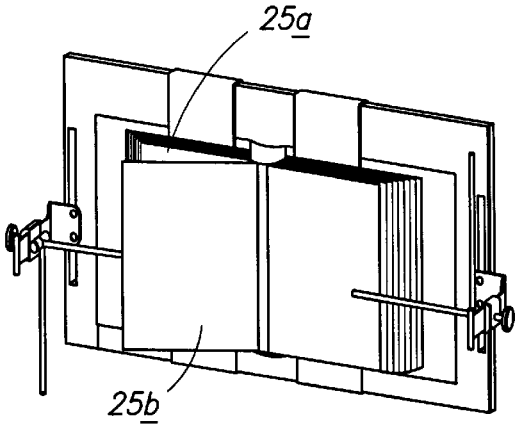
FIGS. 9A–9D are schematic views showing the motion of the device on the left-hand side of the easel in the reverse direction to receive the next turned page and add it to the stack of pages already retained.
Figure 9B:
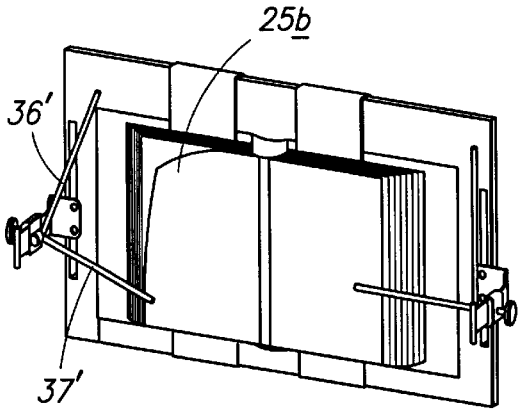
Figure 9C:
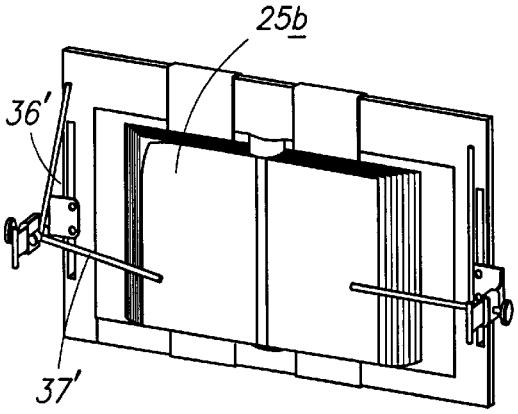
Figure 9D:
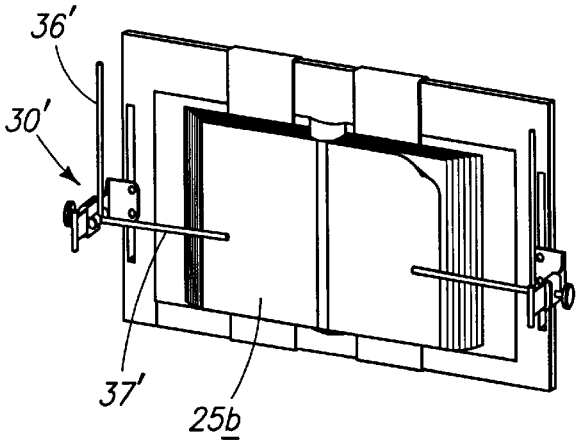

In the sequence of FIGS. 9A–9D, another page 25*b* has been turned for addition to the pages on the left-hand side of the book and, in FIG. 9B, the lower left-hand corner of the page 25*b* is placed underneath the rod 37' as the assembly 30' is now rotated counterclockwise. The rod 36' is rotated out of position as the rod 37' assumes the page retaining function (FIG. 9C) and the left-hand assembly 30' in FIG. 9D is again in the position shown in FIG. 8A, in readiness for another cycle of page turning and page retention.

This procedure continues with alternate clockwise and counterclockwise rotation of the pivoted portions of the right-hand and left-hand assemblies 30 and 30' as pages are successively turned from the right-hand side of the book to the left-hand side. This results in a simple manipulation of the page holder and page turner mechanism. The disclosed structural configuration of the present invention avoids the complexities of the prior art devices and is simple in both fabrication and operation.

It will be understood that the easel together with the related assemblies 30, 30' may be removed from the horizontal support bar 14 and placed on a table or the like in instances where it may be desirable to dispense with use of the stand 13. For languages in which the pages are turned successively, from left to right, the manipulation of the assemblies 30, 30' is simply reversed from the order of the steps described above.

Although there have been described hereinabove various specific arrangements of a BOOK HOLDER WITH INTEGRAL PAGE HOLDER/PAGE TURNER APPARATUS in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A combination book holder and page turning/page retaining apparatus comprising:

a first rotatable assembly having a first element for turning a page and a second element for retaining in place the pages following the turned page;

a second rotatable assembly for retaining the pages which have been turned;

a support member for holding a book in an open position between first and second rotatable assemblies; and means for adjustably mounting the first and second rotatable assemblies to said support member in positions on respective left and right sides of a book supported thereon.

2. The apparatus of claim 1 wherein said support member comprises a pair of releasable straps positioned on opposite sides of the binding of a book for holding the book in place by engaging the book covers.

3. The apparatus of claim 1 wherein the first and second elements of said first rotatable assembly comprise rods affixed generally perpendicularly to each other and to a rotatable pivot member having a pivot axis which is generally orthogonal to the support member.

4. The apparatus of claim 3 wherein said pivot member is slidably mounted on a bracket extending orthogonally from said support member.

5. The apparatus of claim 3 wherein said adjustable mounting means comprise a thin bracket mounted to the support member and including a limb extending outwardly from the support member, an adjustable clamp affixed to said pivot member and attaching it to said bracket limb, and a thumbscrew threaded into said clamp for selectively fixing the position of said clamp along said bracket limb.

6. The apparatus of claim 3 wherein said pivot member and attached orthogonally positioned rods are rotatable about the pivot axis perpendicular to the support member in a reciprocating rotational motion to lift a page for turning while retaining the succeeding pages of the book in position on the support member.

7. The apparatus of claim 6 wherein the movement of the rods by rotation of the pivot member releases a page for turning while bringing the other rod into position to hold the following pages in place against the support member.

8. The apparatus of claim 3 wherein the second rotatable assembly is identical in structure to said first rotatable assembly but is mounted to the support member on the opposite side from the first rotatable assembly to present a mirror image to said first rotatable assembly.

9. The apparatus of claim 8 wherein reciprocal rotation of the second rotatable assembly results in a page being turned for retention by the first rotatable assembly and added to the stack of pages retained by the second rotatable assembly.

10. The apparatus of claim 8 wherein the support member comprises an easel having an adjustable stand for supporting the easel on the floor of a room.

11. The apparatus of claim 10 wherein the stand comprises a vertical telescoping member which is adjustable to vary the height of the easel above the base of the stand and a horizontal telescoping member attached to the vertical member for adjusting the lateral position of the easel.

12. The apparatus of claim 11 further including rotatable coupling means between the easel and the horizontal telescoping member, rotatably adjustable about the horizontal telescoping member to permit the easel to be set at a selected angle from the horizontal.

13. The apparatus of claim 1 wherein each of said first and second rotatable assemblies comprises a pair of orthogonal elongated elements mounted to a pivot member at right angles to each other and to said pivot member, said first assembly being alternatively rotatable in clockwise and counterclockwise directions to bring said elements alternatively into a position to turn a page and a position to retain the remainder of the pages in place on the support member.

14. The apparatus of claim 13 wherein said second rotatable assembly is alternatively rotatable in clockwise and counterclockwise directions to bring said elements alternatively into a position to retain in position against the support member those pages which have previously been turned and to add a page being turned to the stack of pages previously turned.

* * * * *